US012152861B2

(12) United States Patent
Mayer et al.

(10) Patent No.: US 12,152,861 B2
(45) Date of Patent: Nov. 26, 2024

(54) MECHANICAL-MAGNETIC MOUNT FOR A FIREARM

(71) Applicant: CAT AIMING DEVICES USA LLC, Lewes, DE (US)

(72) Inventors: Ernesto Santiago Mayer, Villa Carlos Paz (AR); Walter Ariel Speroni, Villa Carlos Paz (AR)

(73) Assignee: CAT AIMING DEVICES, LLC, Lewes, DE (US)

( * ) Notice: Subject to any disclaimer, the term of this patent is extended or adjusted under 35 U.S.C. 154(b) by 13 days.

(21) Appl. No.: 18/348,662

(22) Filed: Jul. 7, 2023

(65) Prior Publication Data

US 2024/0200905 A1 Jun. 20, 2024

(30) Foreign Application Priority Data

Dec. 16, 2022 (AR) ..... 20220103464

(51) Int. Cl.
*F41G 11/00* (2006.01)

(52) U.S. Cl.
CPC ..... *F41G 11/003* (2013.01)

(58) Field of Classification Search
CPC ..... F41G 1/28
See application file for complete search history.

(56) References Cited

U.S. PATENT DOCUMENTS 1,680,186 A 8/1928 Von Frommer
3,007,248 A 11/1961 Detrich
3,037,288 A 6/1962 Detrich
3,365,801 A 1/1968 De Simone, Jr.
3,979,848 A * 9/1976 Ackerman, Jr. ..... F41G 11/003 42/126
4,102,053 A 7/1978 Colwell
5,276,988 A 1/1994 Swan
5,375,361 A * 12/1994 Rustick ..... F41G 11/003 42/127
5,813,159 A 9/1998 Kay
5,867,930 A 2/1999 Kaminski
5,878,503 A 3/1999 Howe
(Continued)

OTHER PUBLICATIONS

Installation Instructions, OS Line, A new concept in laser devices, CAT, Jan. 2010.

(Continued)

*Primary Examiner* — Derrick R Morgan
(74) *Attorney, Agent, or Firm* — BOOTH UDALL FULLER, PLC; Rodney J. Fuller

(57) ABSTRACT

A firearm accessory mount comprising a mounting plate, a mechanical anchor, and a magnet. The mounting plate has at least two passages through the mounting plate. The mounting plate may be configured to mount on the firearm with the longitudinal axis parallel to a muzzle of the firearm. The passages may be aligned along the longitudinal axis. The mechanical anchor is configured to attach to the firearm and insert into the first passage. The mechanical anchor may have a protruding lip configured to engage with a wall of the first passage distal to the second passage and mechanically hold the mounting plate to the firearm when the mechanical anchor is inserted into the first passage. The magnet is configured to sit within the second passage and magnetically couple to the firearm.

16 Claims, 13 Drawing Sheets

(56) References Cited

U.S. PATENT DOCUMENTS 6,336,285 B1 1/2002 Baumer
6,493,978 B1 12/2002 Perkins
6,725,854 B1 4/2004 Afshari
7,204,052 B2 4/2007 Swan
7,526,890 B1 * 5/2009 Keng ..... F41G 1/26 42/144
7,694,450 B2 4/2010 Keng
8,312,803 B2 11/2012 Oz
8,468,734 B2 6/2013 Meller
8,793,921 B1 * 8/2014 Tonello ..... F41G 11/008 42/125
9,267,759 B2 2/2016 Speroni
10,024,632 B1 * 7/2018 Oglesby ..... F41G 11/003
10,718,592 B1 * 7/2020 Wheeler ..... F41G 1/17
11,959,727 B1 * 4/2024 Yedor ..... F41G 11/003
2005/0241212 A1 * 11/2005 Swan ..... F41G 11/003 42/127
2007/0266611 A1 * 11/2007 Stover ..... F41G 11/004 42/124
2008/0205037 A1 * 8/2008 Griffin ..... F41G 11/003 362/110
2008/0236018 A1 10/2008 Halverson
2008/0244953 A1 * 10/2008 Kilic ..... F41G 11/004 42/127
2009/0126251 A1 * 5/2009 Howe ..... F41G 1/345 42/132
2010/0154280 A1 * 6/2010 LaFrance ..... F41H 5/12 42/106
2010/0175297 A1 7/2010 Speroni
2010/0212208 A1 8/2010 Sims
2011/0076095 A1 * 3/2011 Storch ..... F41G 11/003 403/322.4
2011/0088539 A1 4/2011 Oz
2011/0192068 A1 * 8/2011 Samson ..... F41G 11/003 29/428
2012/0180369 A1 * 7/2012 Koesler ..... F41G 1/345 42/132
2013/0180152 A1 7/2013 Speroni
2013/0185979 A1 7/2013 Fridley
2013/0283660 A1 * 10/2013 Matthews ..... F41G 1/26 42/118
2014/0109457 A1 4/2014 Speroni
2014/0373329 A1 * 12/2014 Volfson ..... F16M 13/02 248/221.11
2015/0241175 A1 * 8/2015 Wolf ..... F41G 11/005 42/124
2015/0285583 A1 10/2015 Mayberry
2017/0059277 A1 * 3/2017 Justice ..... F41G 11/003
2017/0184375 A1 * 6/2017 Huff ..... F41G 11/003
2018/0202770 A1 * 7/2018 Pniel ..... F41G 1/16
2019/0145731 A1 * 5/2019 Stewart ..... F41C 27/00 42/90
2020/0326157 A1 * 10/2020 Curry ..... F41A 21/484
2021/0018298 A1 * 1/2021 Wingfield ..... F41G 1/28
2021/0156650 A1 * 5/2021 Harriman ..... F41G 1/10
2021/0222978 A1 * 7/2021 Bachstein ..... F41A 19/13
2021/0372728 A1 12/2021 Cerda
2022/0034631 A1 * 2/2022 Rosen ..... F41G 1/30
2022/0042773 A1 * 2/2022 Kincel ..... F41C 27/00
2022/0057172 A1 * 2/2022 Roberson ..... F41G 11/003
2022/0057173 A1 * 2/2022 Jacobson ..... F41G 11/002
2023/0184517 A1 * 6/2023 Davis ..... F41G 1/02 42/90
2023/0194212 A1 * 6/2023 Dardzinski ..... F41G 11/001 42/111
2023/0213315 A1 * 7/2023 Planck ..... F41G 11/003 42/111
2023/0228530 A1 * 7/2023 Dawson, Jr. ..... F41G 11/001 42/111
2024/0110769 A1 * 4/2024 Underwood ..... F41G 11/003
2024/0191972 A1 * 6/2024 Elpedes ..... F41G 11/001
2024/0200908 A1 * 6/2024 Fuller ..... F41G 1/30

OTHER PUBLICATIONS

Neodymium Magnet Physical Properties, Feb. 13, 2010, K&J Magnetics Inc., p. 1.

* cited by examiner

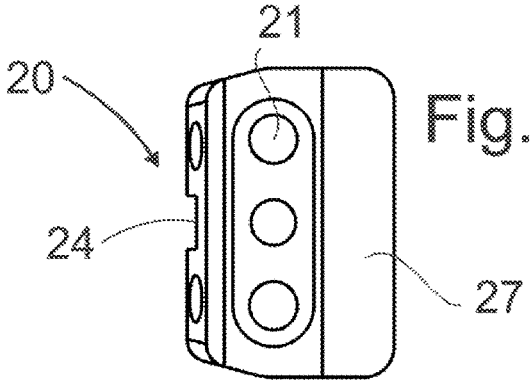
Fig. 16
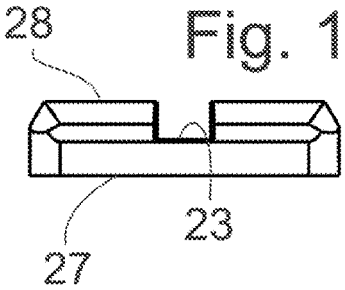
Fig. 17
Fig. 18
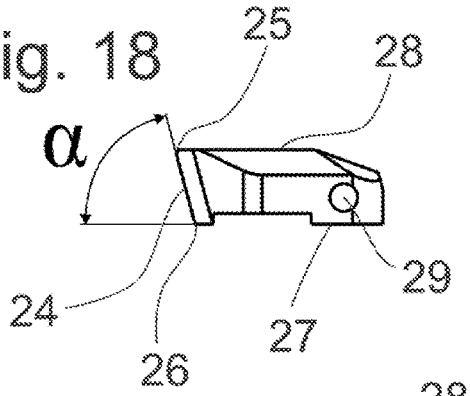
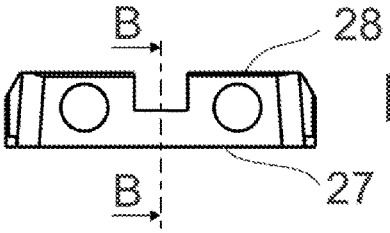
Fig. 19
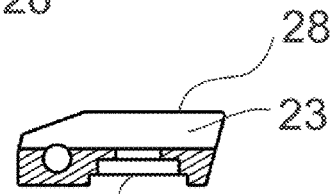
Fig. 21
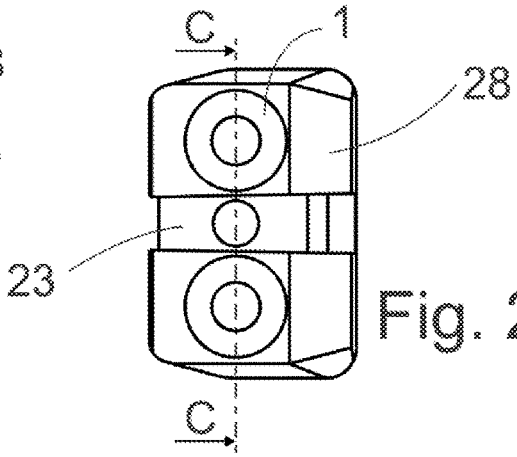
Fig. 20
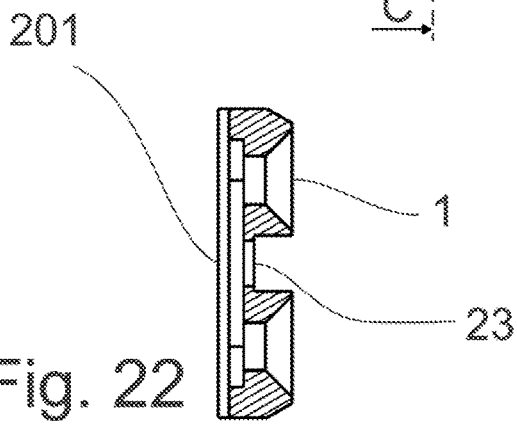
Fig. 22

MECHANICAL-MAGNETIC MOUNT FOR A FIREARM

CROSS REFERENCE TO RELATED APPLICATIONS

This application claims the benefit of the filing date of Argentine Patent Application 20220103464, entitled "Montaje Mecánico-Magnético para Asegurar Accesorios a un Arma" to Ernesto Santiago Mayer, et al. that was filed on Dec. 16, 2022, the disclosure of which is hereby incorporated herein in its entirety by this reference.

TECHNICAL FIELD

Aspects of this document relate generally to a mount for attaching accessories to a firearm, and more specifically to a magnetic mount.

BACKGROUND

Firearms, such as handguns, rifles, and shotguns, are widely used for self-defense, hunting, recreational shooting, and professional applications. Various accessories, such as scopes, lasers, flashlights, and grips, can enhance the functionality, accuracy, and versatility of firearms. These accessories typically need to be securely mounted onto the firearms to ensure stability and proper alignment.

In the past, firearm accessory mounts have been designed using different mechanisms to attach accessories to firearms. Some mounts utilize rails, such as Picatinny or Weaver rails, that are fixed to the firearm's receiver or handguard. These rails allow for the attachment of accessories using compatible mounting systems. However, existing mounts often have limitations in terms of compatibility, ease of installation, and overall performance. Furthermore, conventional accessory mounts may require significant modifications to the firearm and may only be designed for specific firearms. These shortcomings can make the accessory mounts less adaptable to different firearms and less useful for securely mounting accessories on firearms.

SUMMARY

Aspects of this document relate to a firearm accessory mount, comprising a mounting plate having an upper surface, a lower surface opposite the upper surface, and at least two passages through the mounting plate extending from the upper surface to the lower surface, the at least two passages comprising a first passage and a second passage, wherein a length of the mounting plate along a longitudinal axis is larger than a width and a height of the mounting plate, wherein the mounting plate is configured to mount on the firearm with the lower surface adjacent to the firearm and with the longitudinal axis parallel to a muzzle of the firearm, wherein the mounting plate is configured to support an accessory for the firearm on the upper surface, and wherein the at least two passages are aligned along the longitudinal axis, a mechanical anchor configured to fixedly attach to the firearm and insert into the first passage of the at least two passages, the mechanical anchor having a protruding lip configured to engage with a wall of the first passage distal to the second passage and mechanically hold the mounting plate to the firearm when the mechanical anchor is inserted into the first passage, wherein the protruding lip is an oblique sloped surface and the wall of the first passage distal to the second passage is sloped to form a complementary surface to the protruding lip to facilitate engagement between the mechanical anchor and the mounting plate, and a magnet configured to sit within the second passage of the at least two passages and magnetically couple to the firearm, wherein the mechanical anchor is configured to be positioned closer to a rear end of the firearm than the magnet.

Particular embodiments may comprise one or more of the following features. The mechanical anchor may have a top surface with a slit configured to assist the user in aiming the firearm, wherein the slit is configured to align with the longitudinal axis of the mounting plate. The mechanical anchor may have at least two holes extending therethrough, each of the at least two holes configured to receive one of a screw, a dowel, a rivet, and a stud to fixedly attach the mechanical anchor to the firearm. The lower surface of the mounting plate may be shaped to conform to the firearm and the mounting plate is configured to mount on the firearm with the lower surface in contact with the firearm. The firearm accessory mount may further comprise an intermediate plate configured to be positioned between the mounting plate and the firearm and provide a platform for mounting the mounting plate on the firearm. An aperture may extend through the mechanical anchor and a corresponding aperture may extend through each of two opposing walls of the first passage, the aperture of the mechanical anchor configured to align with the corresponding apertures of the two opposing walls to form a lock hole configured to receive a mount lock when the mechanical anchor is inserted into the first passage, wherein when the mount lock extends through the lock hole, the mounting plate is locked to the mechanical anchor.

Aspects of this document relate to a firearm accessory mount, comprising a mounting plate having an upper surface, a lower surface opposite the upper surface, and at least two passages through the mounting plate extending from the upper surface to the lower surface, the at least two passage comprising a first passage and a second passage, wherein the mounting plate is configured to mount on the firearm with the lower surface adjacent to the firearm and with a longitudinal axis of the mounting plate parallel to a muzzle of the firearm, wherein the mounting plate is configured to support an accessory for the firearm on the upper surface, a mechanical anchor configured to attach to the firearm and insert into the first passage of the at least two passages, the mechanical anchor having a protruding lip configured to engage with a wall of the first passage distal to the second passage and mechanically hold the mounting plate to the firearm when the mechanical anchor is inserted into the first passage, and a magnet configured to sit within the second passage of the at least two passages and magnetically couple to the firearm, wherein the mechanical anchor is configured to be positioned closer to a rear end of the firearm than the magnet.

Particular embodiments may comprise one or more of the following features. A length of the mounting plate along the longitudinal axis may be larger than a width and a height of the mounting plate. The at least two passages may be aligned along the longitudinal axis. The protruding lip may be an oblique sloped surface and the wall of the first passage distal to the second passage may be sloped to form a complementary surface to the protruding lip to facilitate engagement between the mechanical anchor and the mounting plate. The mechanical anchor may have a top surface with a slit configured to assist the user in aiming the firearm, wherein the slit is configured to align with the longitudinal axis of the mounting plate. The mechanical anchor may have at least two holes extending therethrough, each of the at least two holes configured to receive one of a screw, a dowel, a rivet, and a stud to fixedly attach the mechanical anchor to the firearm. An aperture may extend through the mechanical anchor and a corresponding aperture may extend through each of two opposing walls of the first passage, the aperture of the mechanical anchor configured to align with the corresponding apertures of the two opposing walls to form a lock hole configured to receive a mount lock when the mechanical anchor is inserted into the first passage, wherein when the mount lock extends through the lock hole, the mounting plate is locked to the mechanical anchor.

Aspects of this document relate to a firearm accessory mount, comprising a mounting plate having an upper surface, a lower surface opposite the upper surface, and at least two passages through the mounting plate extending from the upper surface to the lower surface, wherein the mounting plate is configured to support an accessory for the firearm on the upper surface, a mechanical anchor configured to attach to the firearm and insert into a first passage of the at least two passages, the mechanical anchor configured to engage with the first passage and mechanically hold the mounting plate to the firearm when the mechanical anchor is inserted into the first passage, and a magnet configured to sit within a second passage of the at least two passages and magnetically couple to the firearm.

Particular embodiments may comprise one or more of the following features. The mounting plate may be configured to mount on the firearm with the lower surface adjacent to the firearm and with a longitudinal axis of the mounting plate parallel to a muzzle of the firearm, wherein a length of the mounting plate along the longitudinal axis is larger than a width and a height of the mounting plate, and wherein the at least two passages are aligned along the longitudinal axis. The firearm accessory mount may further comprise an intermediate body positioned between the mechanical anchor and the firearm when the firearm accessory mount is installed on the firearm. The intermediate body may be configured to be inserted into a dovetail slot on the firearm. The mechanical anchor may have a protruding lip configured to engage with a wall of the first passage and mechanically hold the mounting plate to the firearm when the mechanical anchor is inserted into the first passage. The protruding lip may be an oblique sloped surface and the wall of the first passage may be sloped to form a complementary surface to the protruding lip to facilitate engagement between the mechanical anchor and the mounting plate. The mechanical anchor may be configured to be positioned closer to a rear end of the firearm than the magnet.

The foregoing and other aspects, features, and advantages will be apparent from the specification, drawings, and the claims.

BRIEF DESCRIPTION OF THE DRAWINGS

Implementations will hereinafter be described in conjunction with the appended drawings, where like designations denote like elements, and:

FIG. 16 is a bottom view of the mechanical anchor of a firearm accessory mount;

FIG. 17 is a front view of the mechanical anchor shown in FIG. 16;

FIG. 18 is a right-side view of the mechanical anchor shown in FIG. 16;

FIG. 19 is a rear view of the mechanical anchor shown in FIG. 16;

FIG. 20 is a top view of the mechanical anchor shown in FIG. 16;

FIG. 21 is a section view of the mechanical anchor taken from line B-B in FIG. 19;

FIG. 22 is a section view of the mechanical anchor taken from line C-C in FIG. 20;

Figure 1:
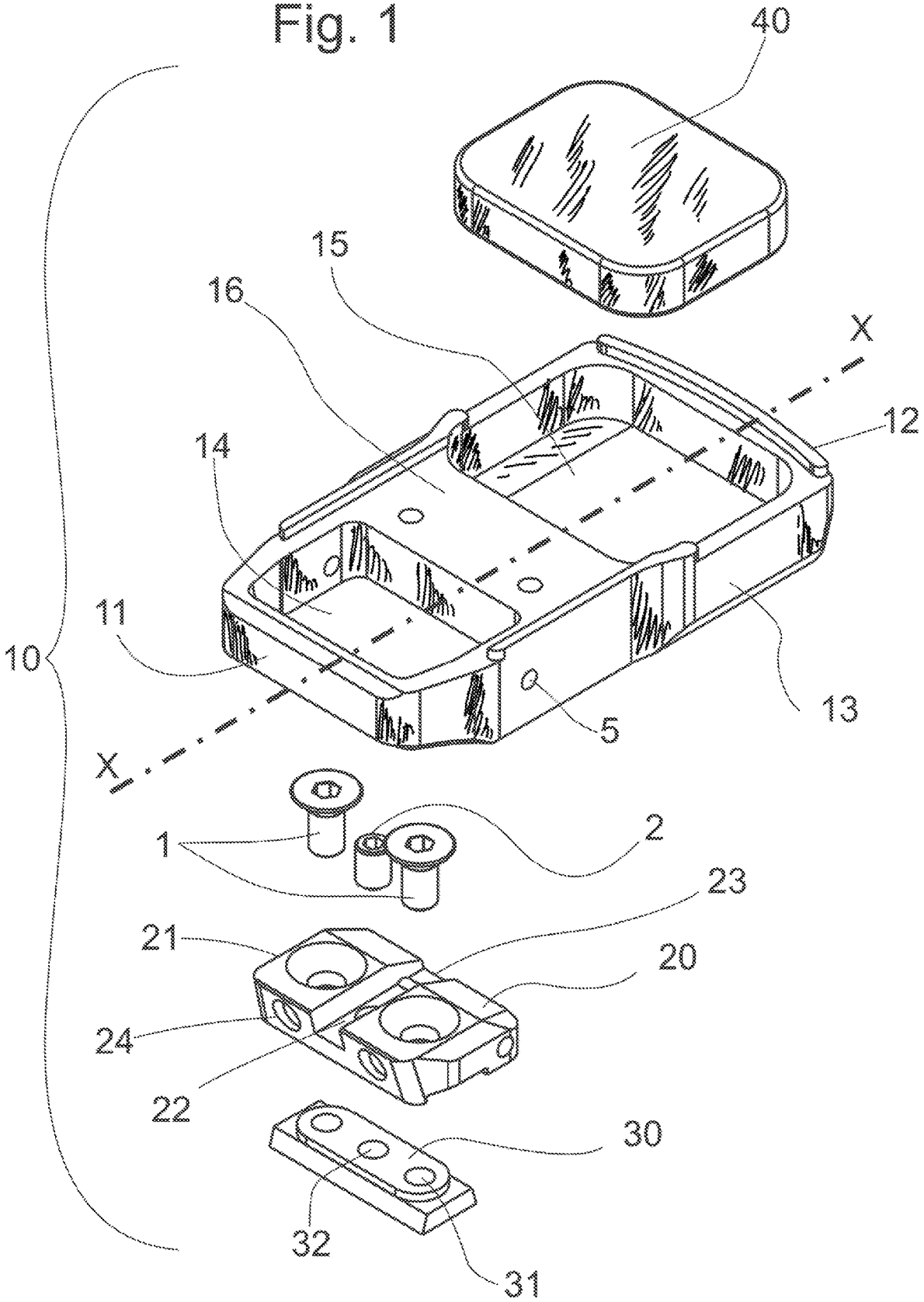
FIG. 1 is an exploded top perspective view of a firearm accessory mount.
Figure 2:
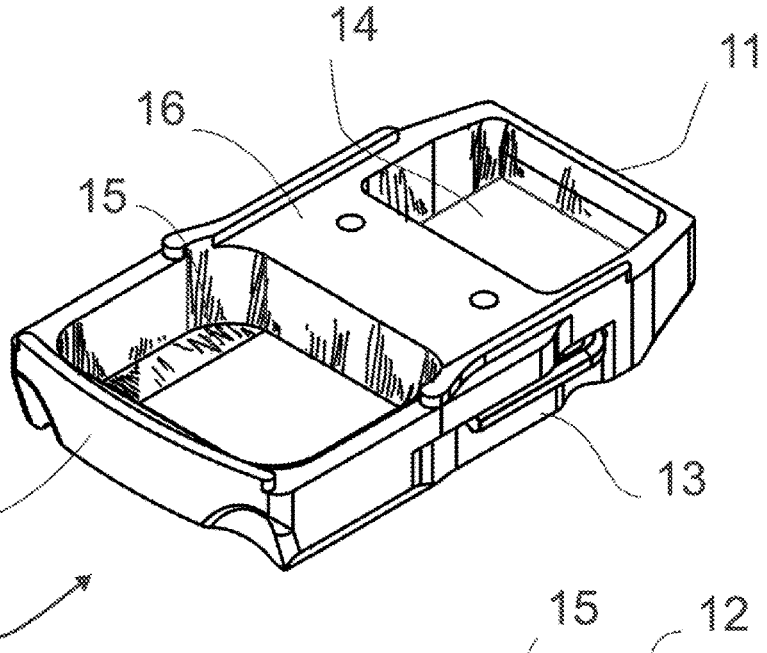
FIG. 2 is a left front perspective view of the mounting body of the firearm accessory mount shown in FIG. 1.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

Figure 35:
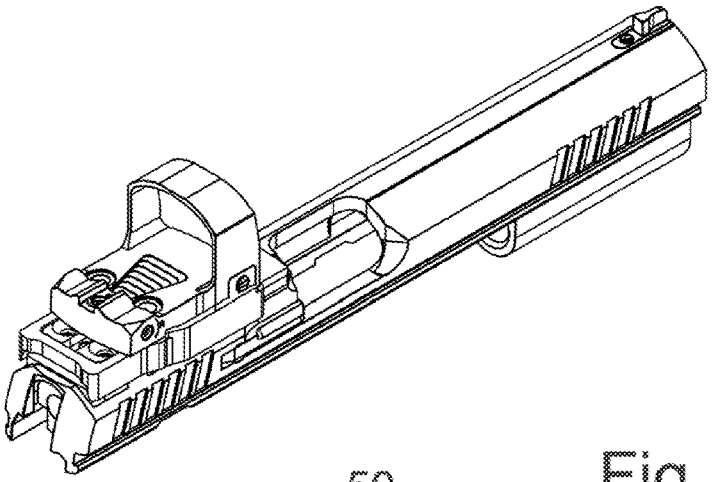
FIG. 35 is a perspective exploded view of a particular embodiment of the firearm accessory mount with an intermediate plate.

The present disclosure is related to a firearm accessory mount 10 (see, e.g., FIG. 1) that is configured to attach to a variety of types and models of firearms 70 (see FIG. 35) with minimal permanent modification to the firearm 70. The firearm accessory mount 10 may be attached or mounted to any type of firearm 70, including a pistol, a revolver, a rifle, an assault rifle, a compressed air rifle, a gas powered firearm, a firearm replica, or any other type of firearm. Some embodiments of the firearm accessory mount 10 are configured to attach to the firearm 70 both mechanically and magnetically.

In some embodiments, the original rear sight of the firearm 70 may be removed and replaced by the mechanical anchor 20 which is disclosed in more detail below. The mechanical anchor 20 may be a rear sight 20.

As shown in FIGS. 1-15, the firearm accessory mount 10 may comprise a substantially flattened mounting plate 13 with a longitudinal axis denoted by line X-X, a mechanical anchor 20 that is configured to attach, either fixedly or removably, to the firearm 70 and provide a mechanical anchor point for holding the mounting plate 13 to the firearm 70 as discussed in more detail below, an intermediate body 30 that is coupled to the mechanical anchor 20 through a plurality of screws 1 and that allows the mechanical anchor 20 to attach to the firearm 70 through a dovetail slot, and a magnet 40 configured to hold the firearm accessory mount 10 in its ideal position for use. The magnet 40 may have any of a variety of shapes and sizes. The screws 1 may be replaced by dowels, studs, or any other fasteners known in the art.

Figure 3:
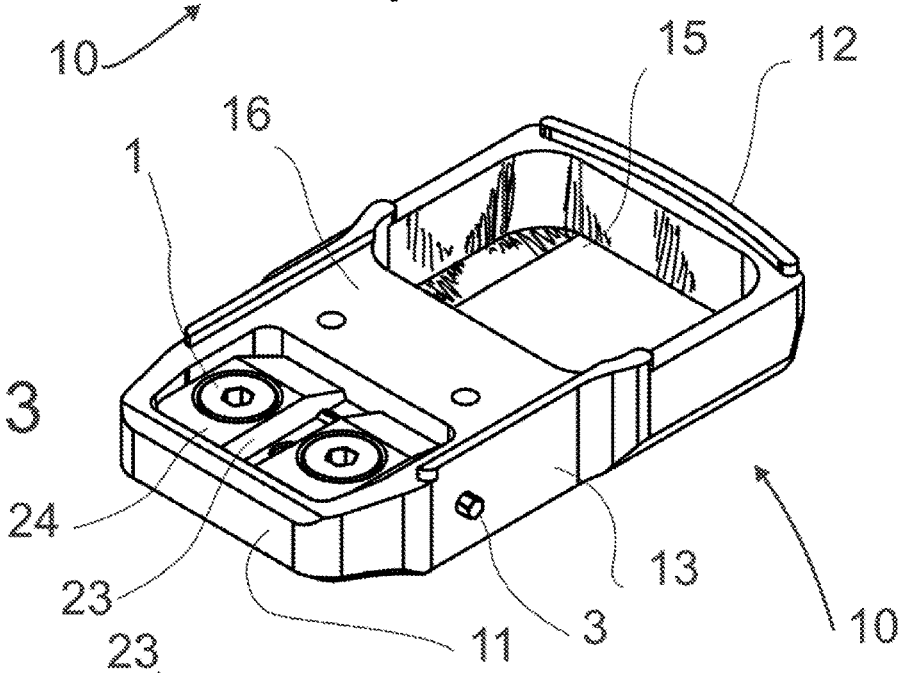
FIG. 3 is a right rear isometric perspective view of the mounting body of the firearm accessory mount shown in FIG. 1 with the mechanical anchor in the first passage.
Figure 4:
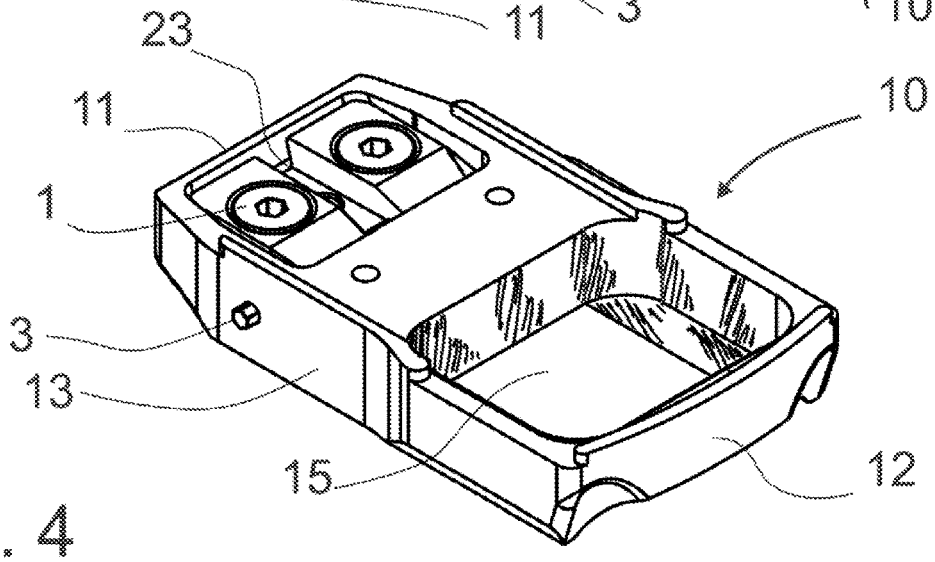
FIG. 4 is a right front isometric perspective view of the mounting body of the firearm accessory mount shown in FIG. 1 with the mechanical anchor in the first passage.
Figure 5:
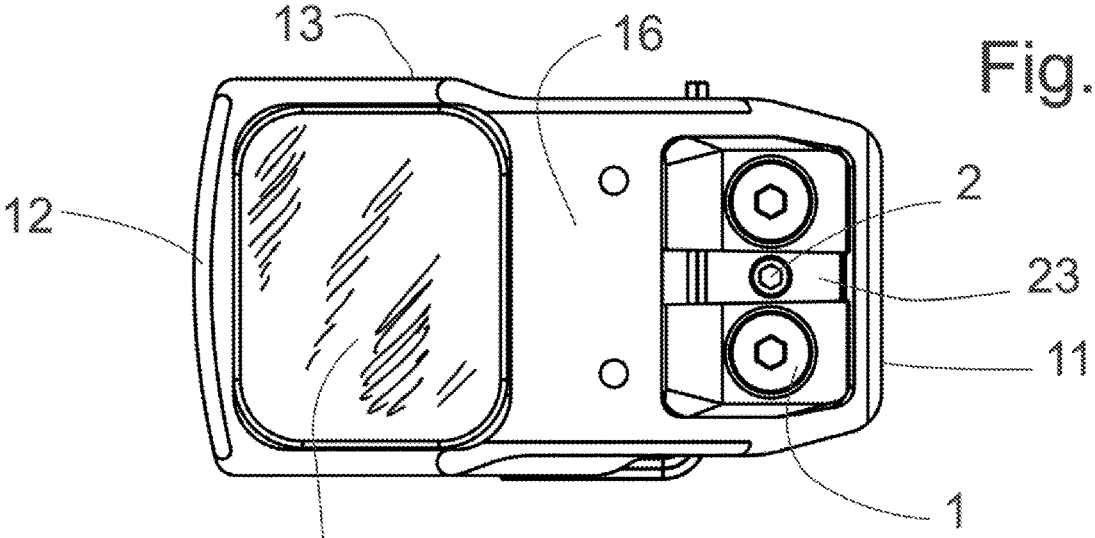
FIG. 5 is a top view of the firearm accessory mount shown in FIG. 1.
Figure 6:
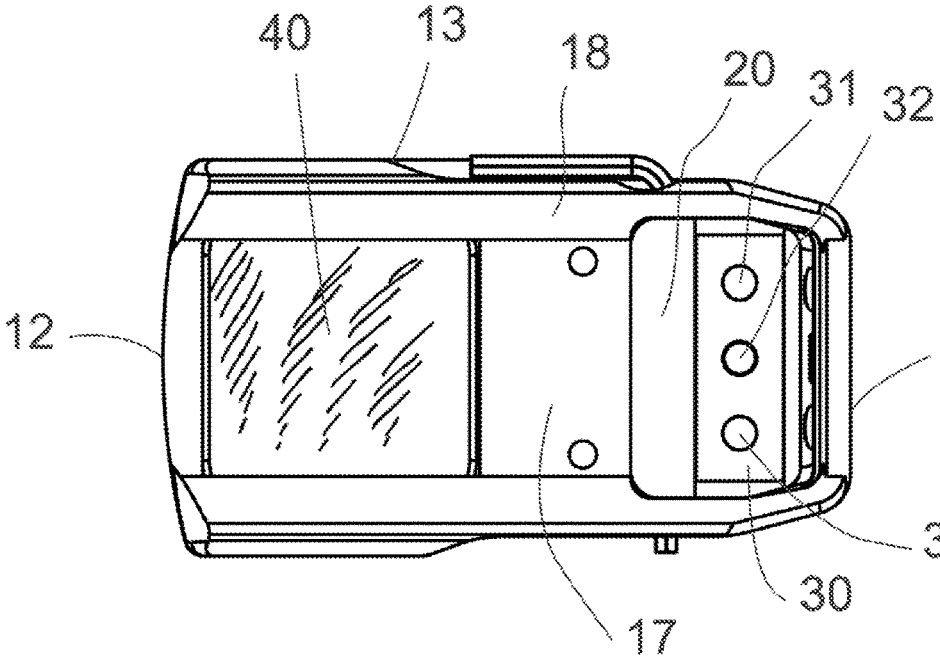
FIG. 6 is a bottom view of the firearm accessory mount shown in FIG. 1.
Figure 7:
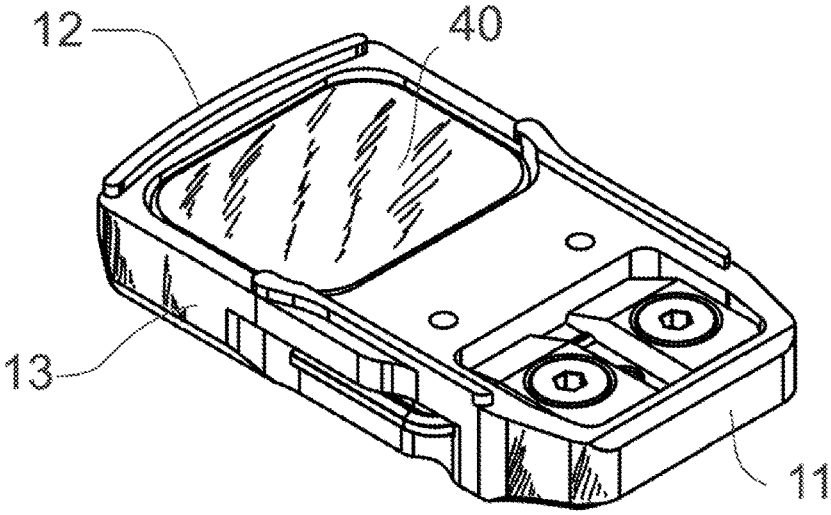
FIG. 7 is a left rear isometric perspective view of the firearm accessory mount shown in FIG. 1.

In some embodiments, a mount lock 3 may be included on the side of the mechanical anchor 20 (see FIG. 3). The mount lock 3 may include a side screw, a hex key, or a similar tool that can be used to make adjustments to the aiming devices 50 placed on the firearm accessory mount 10. The mount lock 3 adds an additional security feature to the attachment of the firearm accessory mount 10 to the firearm 70. To accommodate the mount lock 3, the mechanical anchor 20 may have an aperture 29 extending therethrough (see FIG. 18). A corresponding aperture 5 may extend through each of two opposing walls of the first passage 14 (see FIG. 1). The aperture 29 is configured to align with the corresponding apertures 5 to form a lock hole that is configured to receive the mount lock 3 when the mechanical anchor 20 is inserted into the first passage 14. When the mount lock 3 extends through the lock hole, the mounting plate 13 is locked to the mechanical anchor 20. In this way, the mount lock 3 further secures the firearm accessory mount 10 to the firearm 70.

The screws 1 may be positioned vertically on the upper face 28 of the mechanical anchor 20 and, in embodiments that have an intermediate body 30, are configured to threadedly couple the mechanical anchor 20 to the intermediate body 30.

There may also be a central screw 2 configured to provide additional support to the intermediate body 30. The central screw 2 increases the tension between the mechanical anchor 20 and the intermediate body 30 and helps to limit movement. The central screw 2 screws into the intermediate body 30.

As mentioned above, the mounting plate 13 may be substantially flattened, with a height of the mounting plate 13 being at least twice as small as a width and a length of the mounting plate 13. The mounting plate 13 has a rear wall 11 that is configured to be oriented towards the rear end of the firearm 70 and a front wall 12 that is configured to be oriented towards the front end or the muzzle of the firearm 70. The mounting plate 13 may have a quadrangular shape with a substantially uniform height. The mounting plate 13 has an upper surface 16 and a lower surface 17 opposite the upper surface 16. The upper surface 16 may be a platform and is configured to support an accessory 50 for the firearm 70. The lower surface 17 is configured to be adjacent to the firearm 70 and may be in contact with the firearm 70 when the mounting plate 13 is installed on the firearm 70. Additionally, the longitudinal axis X-X of the mounting plate 13 may be configured to be parallel to the muzzle of the firearm 70. Each of the upper surface 16 and the lower surface 17 of the mounting plate 13 may be modified to better perform their respective purposes. For example, the upper surface 16 may be modified to serve as a platform for different types of aiming devices, such as a red dot sight, a laser, or another aiming device, and the lower surface 17 may be modified to better conform to the firearm 70. This shape may depend on the specific firearm 70 to be used, as shown by a comparison of FIGS. 9 and 12.

The mounting plate 13 may have at least two passages through the mounting plate 13, including a first passage 14 and a second passage 15, extending from the upper surface 16 to the lower surface 17. The first passage 14 is configured to be positioned towards the rear of the firearm 70, while the second passage 15 is configured to be positioned towards the front or muzzle of the firearm 70. The first passage 14 and the second passage 15 may be aligned along the longitudinal axis X-X of the mounting plate 13. The mechanical anchor 20 is configured to insert into the first passage 14 and the magnet 40 is configured to sit within the second passage 15. The magnet 40 is retained within the second passage 15 at least by the walls of the second passage 15 and by a magnetic coupling between the magnet 40 and the firearm 70. In some embodiments, the magnet 40 is also magnetically coupled to the walls of the second passage 15 to hold the magnet 40 within the second passage 15. As shown in FIGS. 5-11, the mounting plate 13 may include a ledge 18 on either side of the mounting plate 13 that slightly extends into the second passage 15. The ledges 18 may help to physically stop the mounting plate 13 from lifting up from the firearm 70 when the magnet 40 is magnetically coupled to the firearm 70 within the second passage 15. The magnet 40 may be shaped to conform with the walls of the second passage 15.

Illustrated in more detail in FIG. 16-22, the mechanical anchor 20 may have holes 21 and 22 that extend through the mechanical anchor from the upper face 28 or top surface 28 of the mechanical anchor 20 to the lower face 27 of the mechanical anchor 20. The holes 21, 22 may be configured to align with the holes 31, 32 on the intermediate body 30 to allow the screws 1, 2 to pass through and secure the mechanical anchor 20 to the firearm 70. The screws 1, 2, may be replaced by some other fastener, such as a dowel, a rivet, or a stud. Other fasteners known in the art may be used. The mechanical anchor 20 may also have a slit 23 configured to assist the user in aiming the firearm 70. The slit 23 may be configured to align with the longitudinal axis X-X of the mounting plate 13. Additionally, the slit 23 may be positioned between the holes 21, 22 extending through the mechanical anchor 20.

Figure 10:
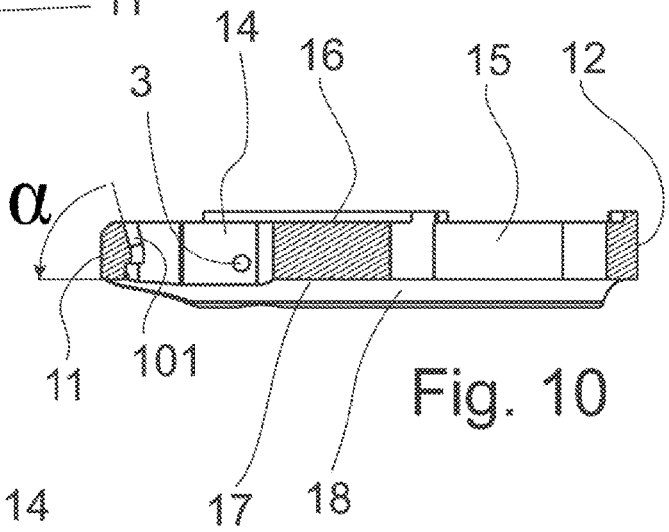
FIG. 10 is a section view of the firearm accessory mount taken from line A-A in FIG. 9.

The mechanical anchor 20 may also have a protruding lip 24 oriented towards the rear end of the firearm 70. The protruding lip 24 may be an oblique sloped surface with an upper end 25 directed towards the rear end of the firearm 70 and a lower end 26 directed towards the front end of the firearm 70. The protruding lip 24 is configured to engage with the rear wall 11 of the mounting plate 13, which is distal to the second passage 15, and mechanically hold the mounting plate 13 to the firearm 70 when the mechanical anchor 20 is inserted into the first passage 14. The rear wall 11 of the mounting plate 13 may be sloped on the inside of the first passage 14 to form a complementary sloped surface 101 to the protruding lip 24, as shown in FIGS. 10 and 11.

Figure 47:
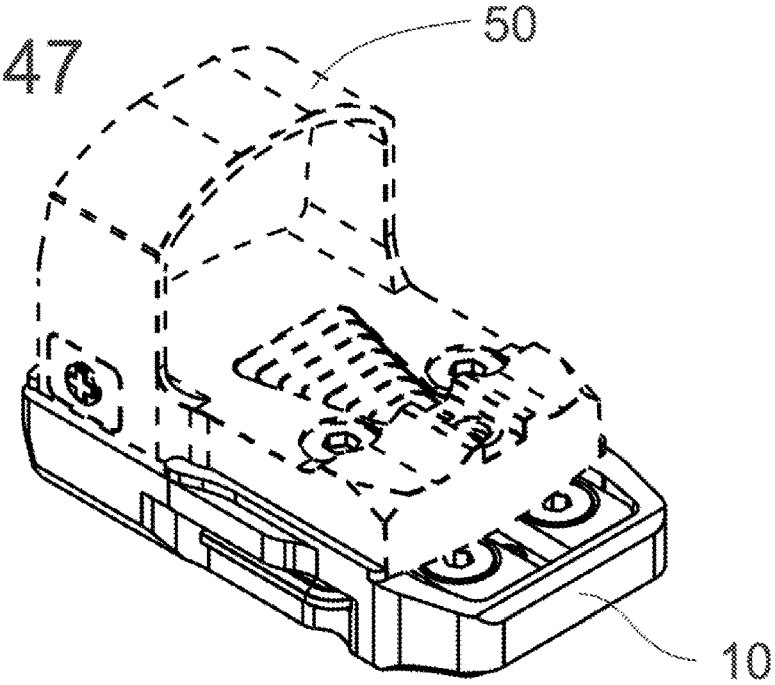
FIG. 47 is a perspective view of a firearm accessory attached to the firearm accessory mount.
Figure 48:
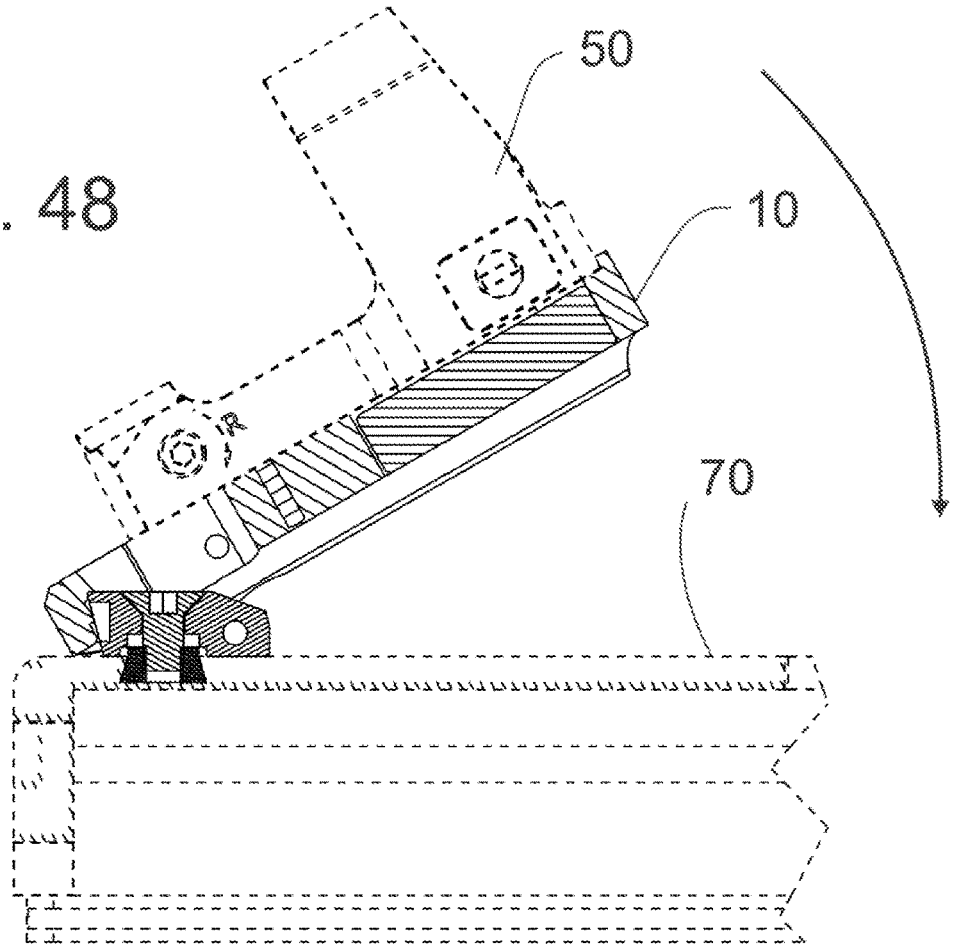
FIG. 48 is a section view showing the firearm accessory and the firearm accessory mount being installed on a firearm.
Figure 49:
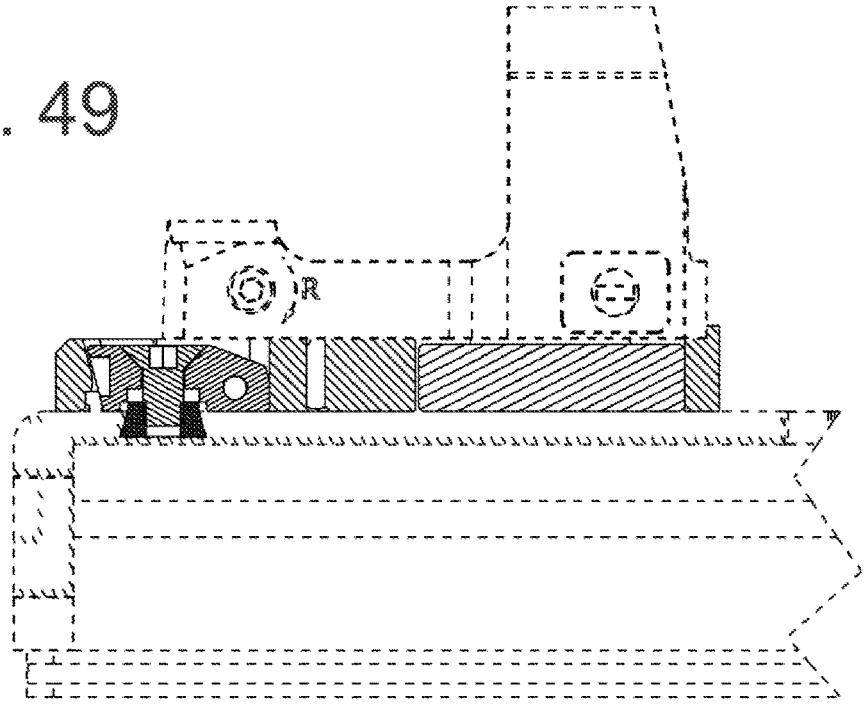
FIG. 49 is a section view showing the firearm accessory and the firearm accessory mount already installed on a firearm.

The sloped surface 101 has an angle $\alpha$ with respect to the upper surface 16 of the mounting plate 13. This may help facilitate engagement between the mechanical anchor 20 and the mounting plate 13. The mechanical anchor 20 is therefore sized to insert into the first passage 14 at particular angles of the mounting plate 13 with respect to the firearm 70, but is large enough that, once the mechanical anchor 20 has been inserted and the mounting plate 13 is rotated to rest on the firearm 70, the protruding lip 24 engages with the rear wall 11 of the mounting plate 13 to hold the mounting plate 13 to the firearm 70 (see FIGS. 47-49). Once the magnet 40 is inserted into the second passage 15, the magnet 40 holds the mounting plate 13 to the firearm 70 and prevents rotation of the mounting plate 13 to a position where the mounting plate 13 might disengage from the mechanical anchor 20. The angle α may be selected to allow easy insertion of the mechanical anchor 20 into the first passage 14 at a specific angle, but then to restrict movement of the mounting plate 13 once the mounting plate has been rotated to rest on the firearm 70.

Figure 9:
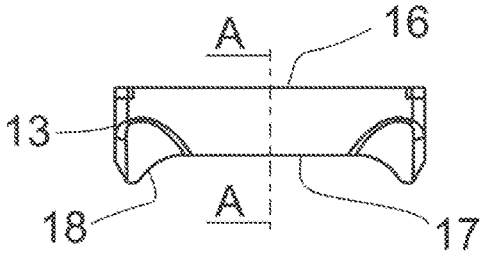
FIG. 9 is a front view of the firearm accessory mount shown in FIG. 8.

The ledges 18, which extend along the sides of the mounting plate 13 may be curved downward toward the firearm 70 to curve around the firearm 70 and stabilize the mounting plate 13 on the firearm 70, as shown in FIG. 9.

Figure 8:
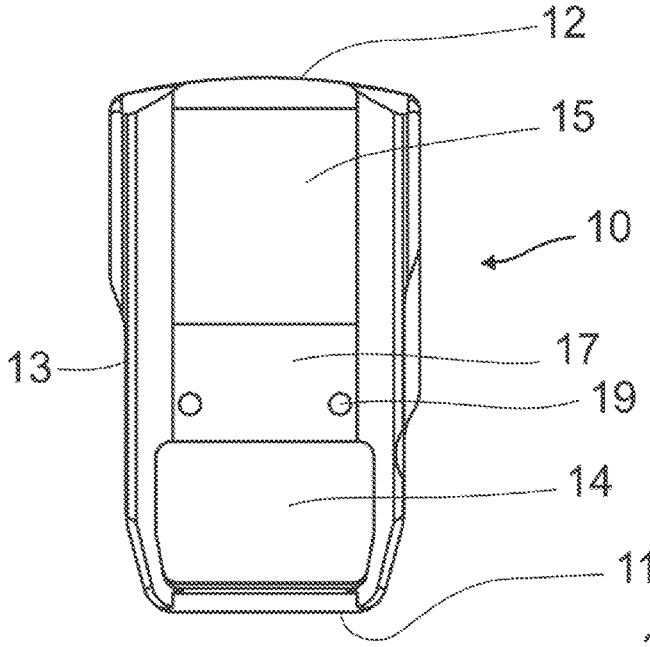
FIG. 8 is a bottom view of another embodiment of a firearm accessory mount, without the mechanical anchor or magnet.
Figure 11:
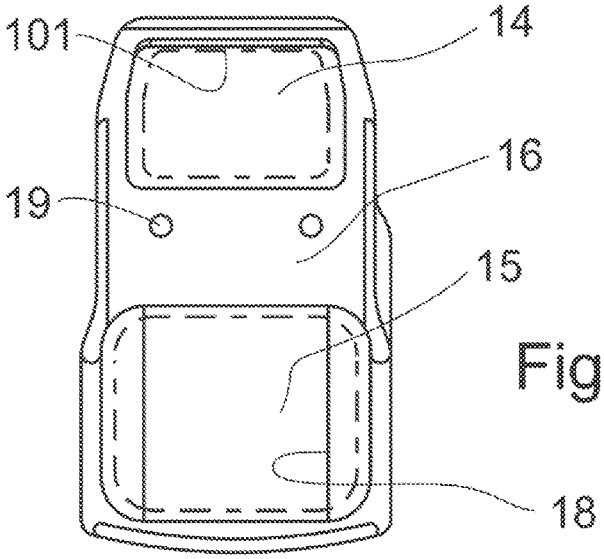
FIG. 11 is a top view of the firearm accessory mount shown in FIG. 8.
Figure 12:
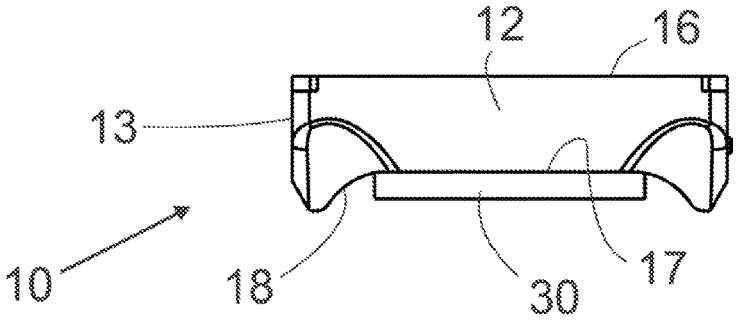
FIG. 12 is a front view of another embodiment of a firearm accessory mount.
Figure 13:
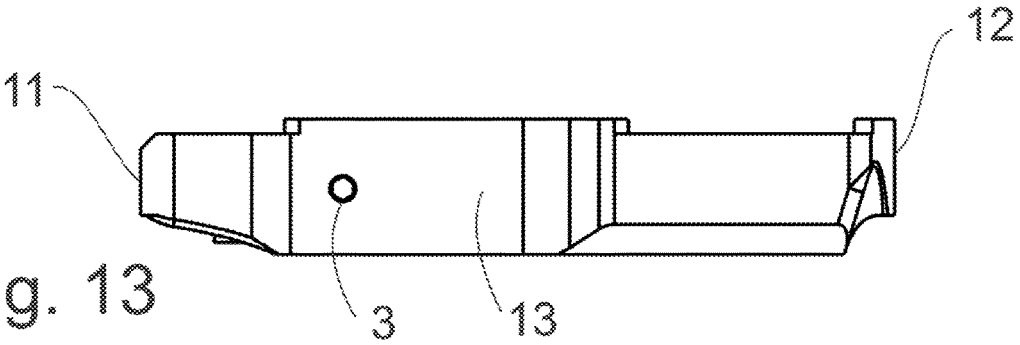
FIG. 13 is a side view of the firearm accessory mount shown in FIG. 12.
Figure 14:
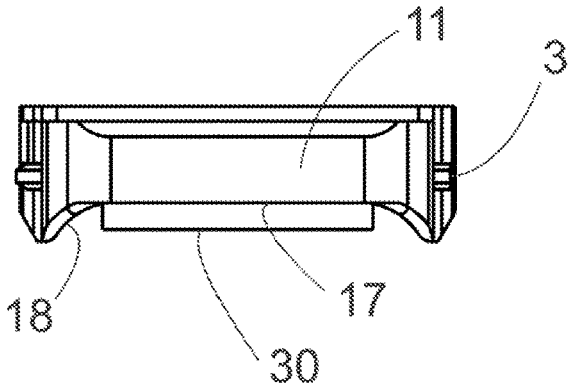
FIG. 14 is a rear view of the firearm accessory mount shown in FIG. 12.
Figure 15:
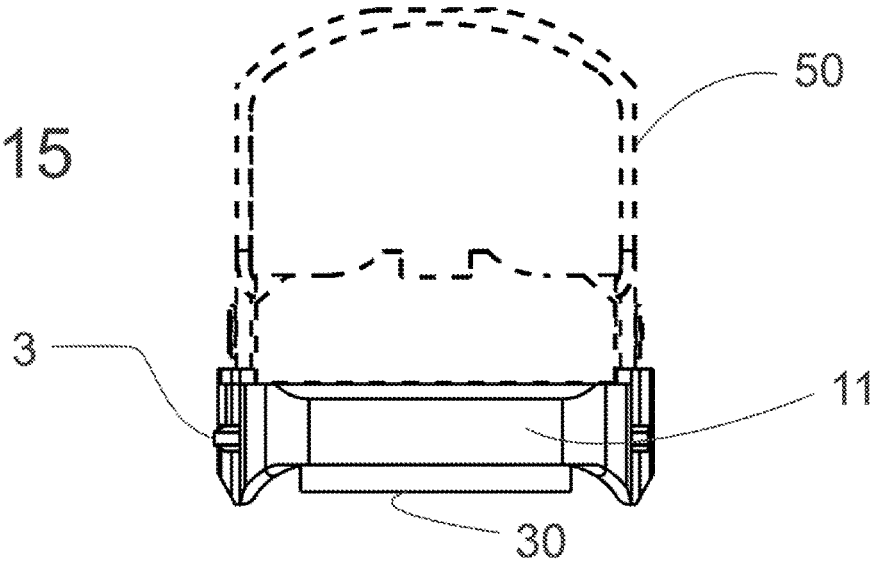
FIG. 15 is the same view of the firearm accessory mount as shown in FIG. 14 with a sight accessory attached to the mounting body.
Figure 23:
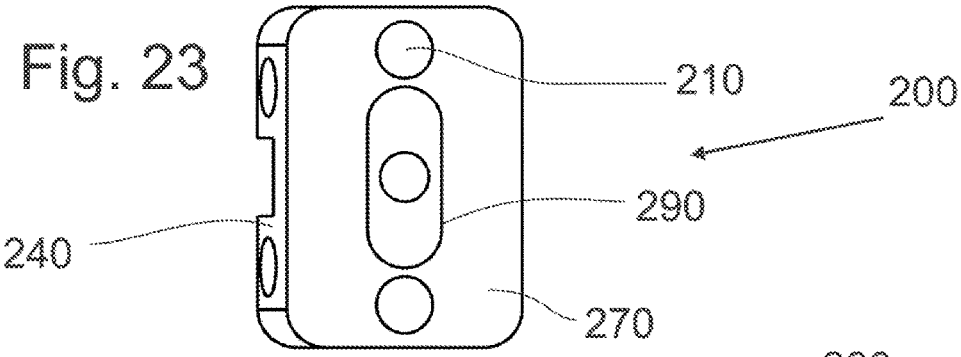
FIG. 23 is a bottom view of another embodiment of the mechanical anchor.
Figure 24:
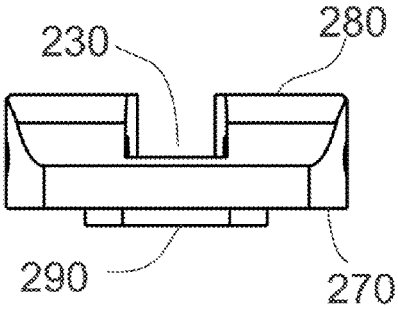
FIG. 24 is a front view of the mechanical anchor shown in FIG. 23.
Figure 25:
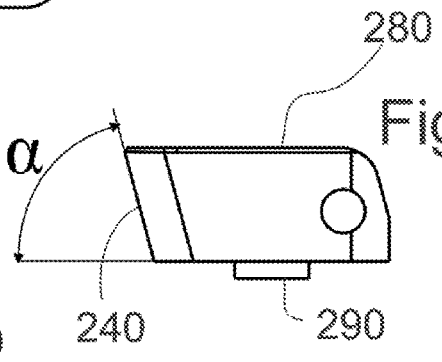
FIG. 25 is a right-side view of the mechanical anchor shown in FIG. 23.
Figure 26:
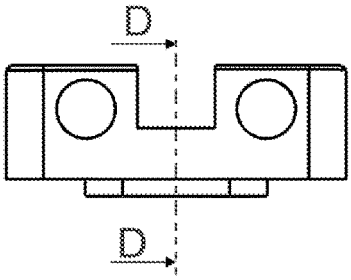
FIG. 26 is a rear view of the mechanical anchor shown in FIG. 23.
Figure 27:
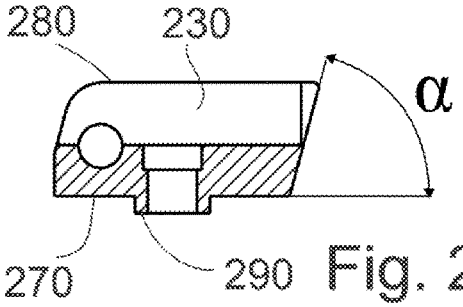
FIG. 27 is a section view of the mechanical anchor taken from line D-D in FIG. 26.
Figure 28:
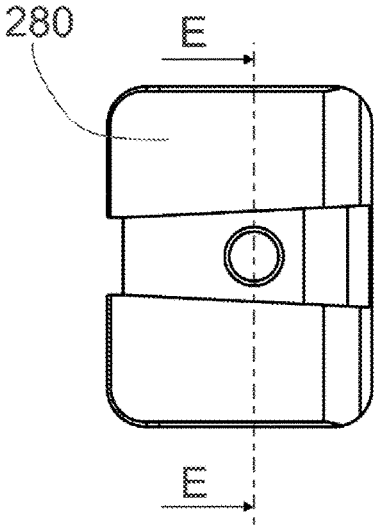
FIG. 28 is a top view of the mechanical anchor shown in FIG. 23.
Figure 29:
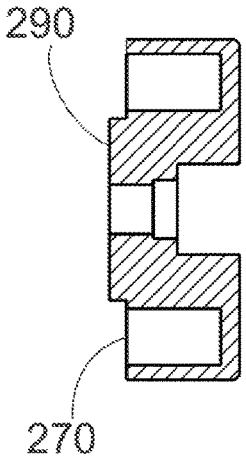
FIG. 29 is a section view of the mechanical anchor taken from line E-E in FIG. 28.
Figure 30:
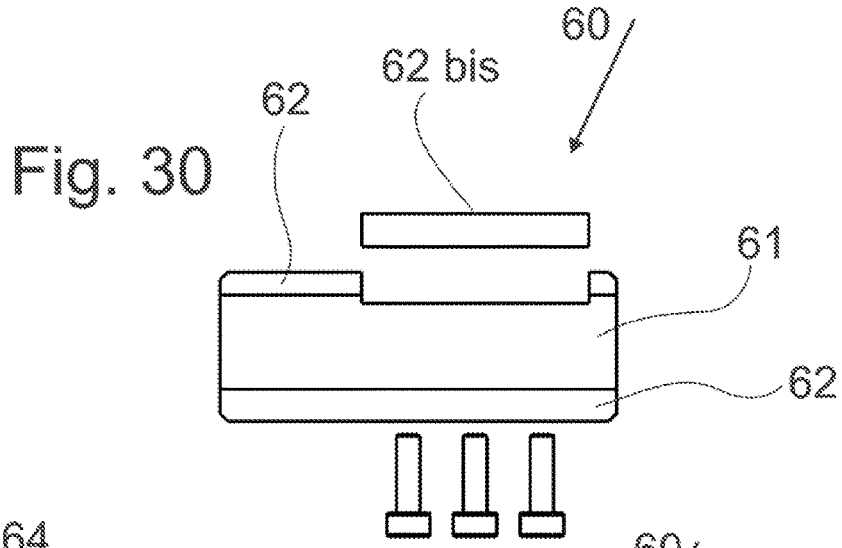
FIG. 30 is a bottom view of another embodiment of the mechanical anchor, suited for use with a Picatinny or Weaver rail.
Figure 31:
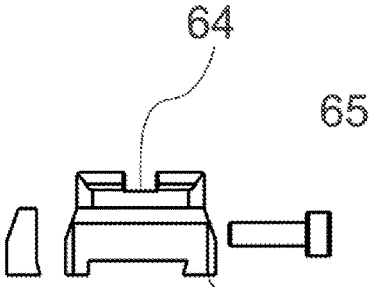
FIG. 31 is a front view of the mechanical anchor shown in FIG. 30.
Figure 32:
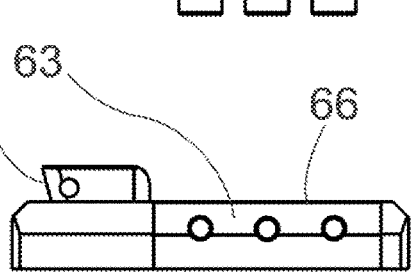
FIG. 32 is a right-side view of the mechanical anchor shown in FIG. 30.
Figure 33:
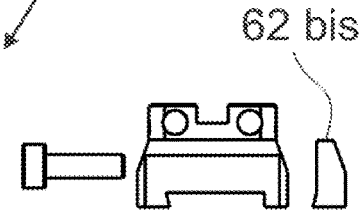
FIG. 33 is a rear view of the mechanical anchor shown in FIG. 30.
Figure 34:
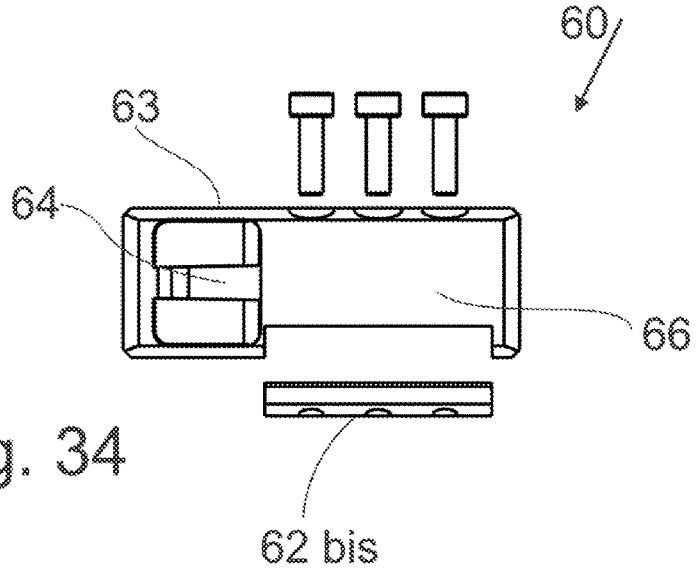
FIG. 34 is a top view of the mechanical anchor shown in FIG. 30.

As shown at least in FIGS. 8 and 11, the top surface of the mounting plate 13 may have a plurality of holes 19 configured to enable attachment of firearm accessories 50 to the mounting plate 13. As shown in FIG. 15, the firearm accessory 50 may thus be coupled or attached to the mounting 13 using screws inserted into the plurality of holes 19. Because the accessory 50 attaches to the mounting plate 13 instead of directly to the firearm 70, the user can use different accessories 50 and make modifications to the firearm accessory mount 10 without needing to make permanent modifications to the firearm 70 itself.

The firearm accessory mount 10 enables the mounting of heavier and larger accessories including optical elements because it better supports the effect caused by the inertia of the shot and the recoil. Additionally, the firearm accessory mount 10 is easily adaptable to many different firearms 70 because it does not require a specific shape of firearm to attach it to the firearm 70. Because the firearm accessory mount 10 is formed or manufactured from a metal material in some embodiments, different design aesthetics may also be easily implemented.

Figure 36:
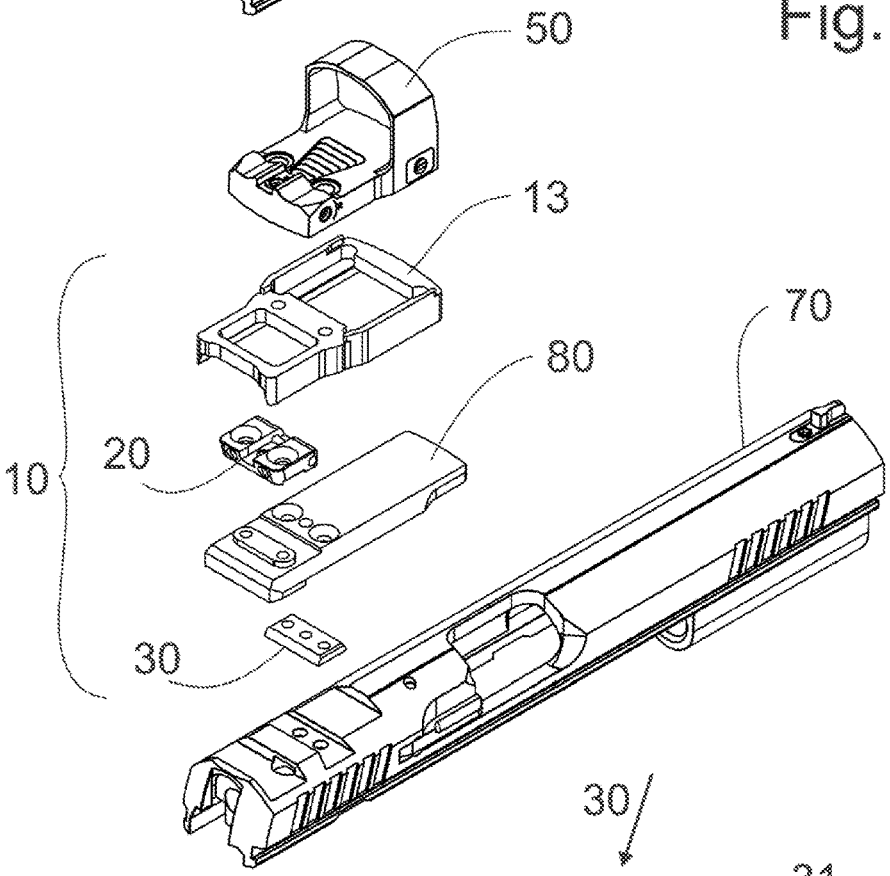
FIG. 36 is a front or rear view of the intermediate plate shown in FIG. 35.
Figure 36:
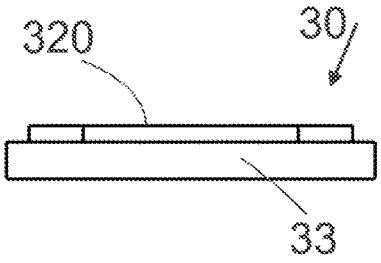
Figure 37:
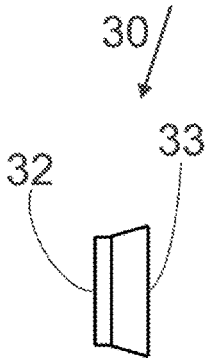
FIG. 37 is a side view of the intermediate plate shown in FIG. 35.
Figure 38:
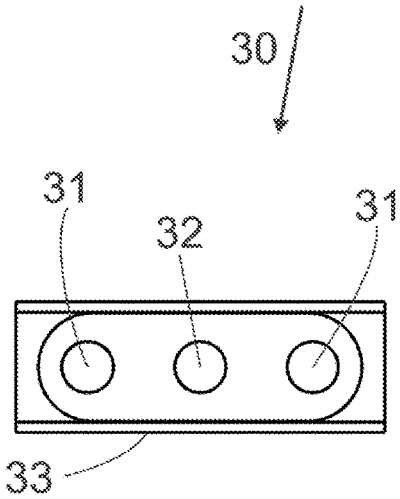
FIG. 38 is a top view of the intermediate plate shown in FIG. 35.
Figure 39:
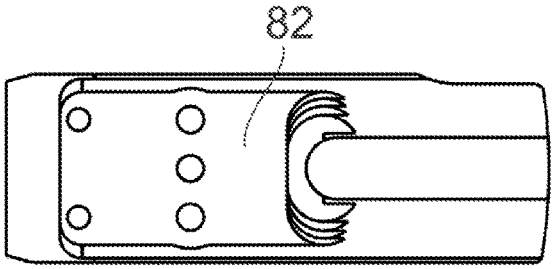
FIG. 39 is a bottom view of another embodiment of the intermediate plate.
Figure 40:
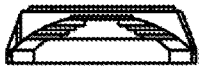
FIG. 40 is a front view of the intermediate plate shown in FIG. 39.
Figure 41:
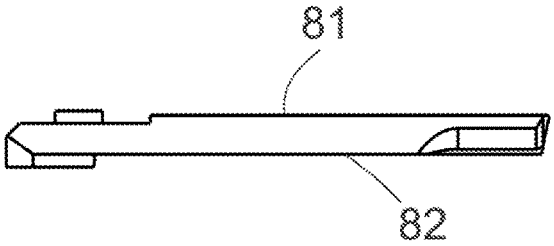
FIG. 41 is a right-side view of the intermediate plate shown in FIG. 39.
Figure 42:
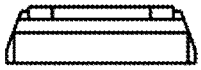
FIG. 42 is a rear view of the intermediate plate shown in FIG. 39.
Figure 43:
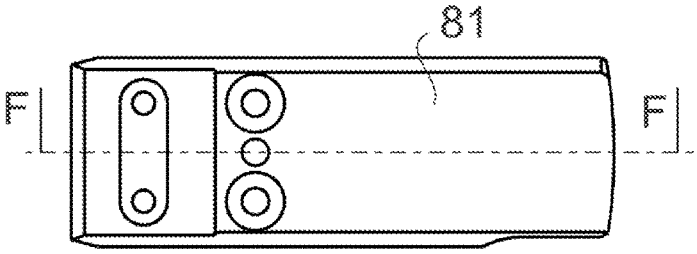
FIG. 43 is a top view of the intermediate plate shown in FIG. 39.
Figure 44:
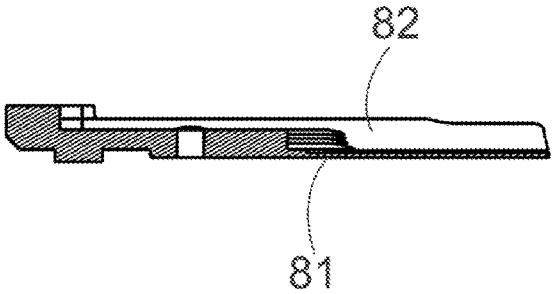
FIG. 44 is a section view of the intermediate plate taken from line F-F in FIG. 43.
Figure 45:
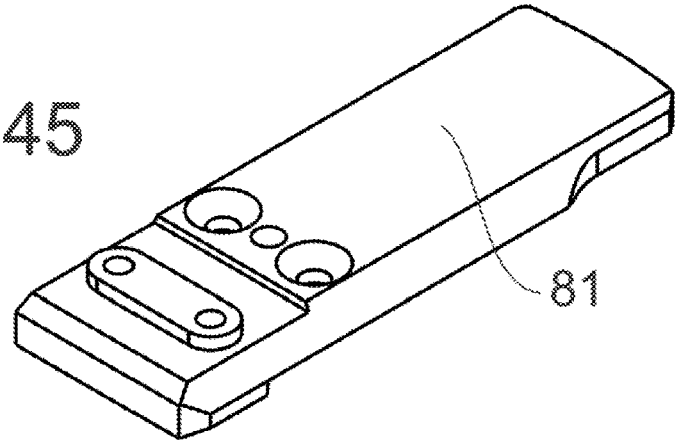
FIG. 45 is a top perspective view of the intermediate plate shown in FIG. 39.
Figure 46:
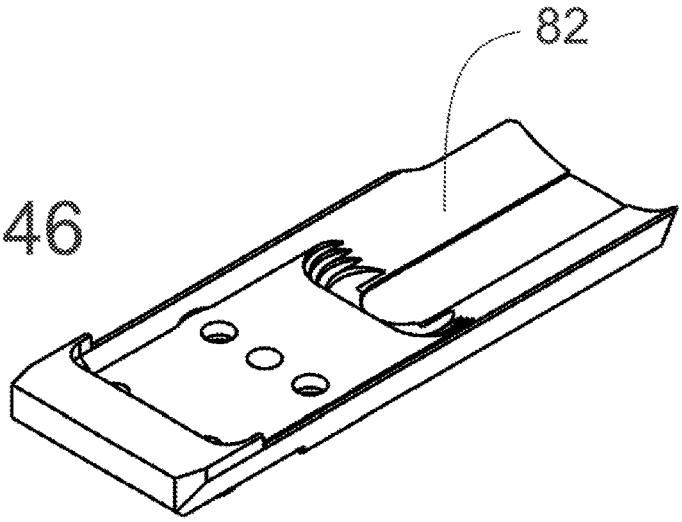
FIG. 46 is a bottom perspective view of the intermediate plate shown in FIG. 39.

The mechanical anchor 20 may have a cavity 201 (see FIG. 21) configured to receive a pedestal 320 of the intermediate body 30 (see FIGS. 36-38). The pedestal 320 helps to align the mechanical anchor 20 and the intermediate body 30. The cavity 201 makes the firearm accessory mount 10 more adaptable to different firearms. The cavity 201 is sized so that the pedestal 320 of the intermediate body 30 does not come into contact with the mechanical anchor 20 within the cavity 20. In embodiments that have the intermediate body 30 in a dovetail slot in the firearm 70, this makes it so that, when the screws 1, 2 are tightened into the intermediate body 30, the screw 1, 2 pull the intermediate body 30 upward, tightening the inclined surfaces 33 of the intermediate body 30 against the dovetail slot in the firearm 70. This also tightens the lower face 27 of the mechanical anchor 20 against the firearm 70 or an intervening component and helps improve the contact between the protruding lip 24 of the mechanical anchor 20 and the sloped surface 101 of the mounting plate 13.

FIGS. 23-29 illustrate another embodiment of the mechanical anchor 200 that includes a rear sight, but may not use the intermediate body 30. Instead, the intermediate body 30 is replaced by a projection 290 extending from the underside 270 of the mechanical anchor 200. The mechanical anchor 200 may have any feature that the mechanical anchor 20 has. For example, the mechanical anchor 200 has a protruding lip 240 similar to the protruding lip 24 and holes 210 similar to holes 21, 22. The mechanical anchor 200 also has an upper surface 280 with a slit 230 that is similar to the slit 23. The lower surface 270 of the mechanical anchor 200 is configured to contact the firearm 70, and therefore may be shaped to increase the surface area of the contact between the mechanical anchor 200 and the firearm 70. In some embodiments, therefore, the lower surface 270 is flat, while in other embodiments, the lower surface 270 may be concave. The slit 230 may be configured to align with the longitudinal axis X-X of the mounting plate 13. The slit 230 may be without a roof, may be a tunnel, or may be replaced by a transparent material or an electronic or other type of aiming system.

FIGS. 30-34 illustrate another embodiment of the mechanical anchor 60 that may not use the intermediate body 30. This embodiment may be used with an 11 mm Weaver rail, a MIL-STD-1913 Picatinny rail, or another rail with similar characteristics. The mechanical anchor 60 has sides 63, two parallel ribs 62 that extend away from the face or inferior surface and frame a longitudinal recession 61. A side component **62*bis* may help couple the mechanical anchor 60 together with screws. The mechanical anchor 60 also has a slit 64 on the upper surface 66 of the mechanical anchor 60 to aid in aiming the firearm 70 and a protruding lip 65 to engage with the mounting plate 13**.

In some embodiments, an intermediate plate 80 is positioned between the mounting plate 13 and the firearm 70. The intermediate plate 80 is configured to adapt the shape of the firearm 70 to support the firearm accessory mount 10. The intermediate plate 80 may also be positioned between the mechanical anchor 20 and the intermediate body 30 (see FIG. 35). As shown in FIGS. 39-46, the intermediate plate 80 has an upper surface 81 and a lower surface 82. The intermediate plate 80 is configured to provide a platform for mounting the mounting plate 13 on the firearm 70.

Figure 50:
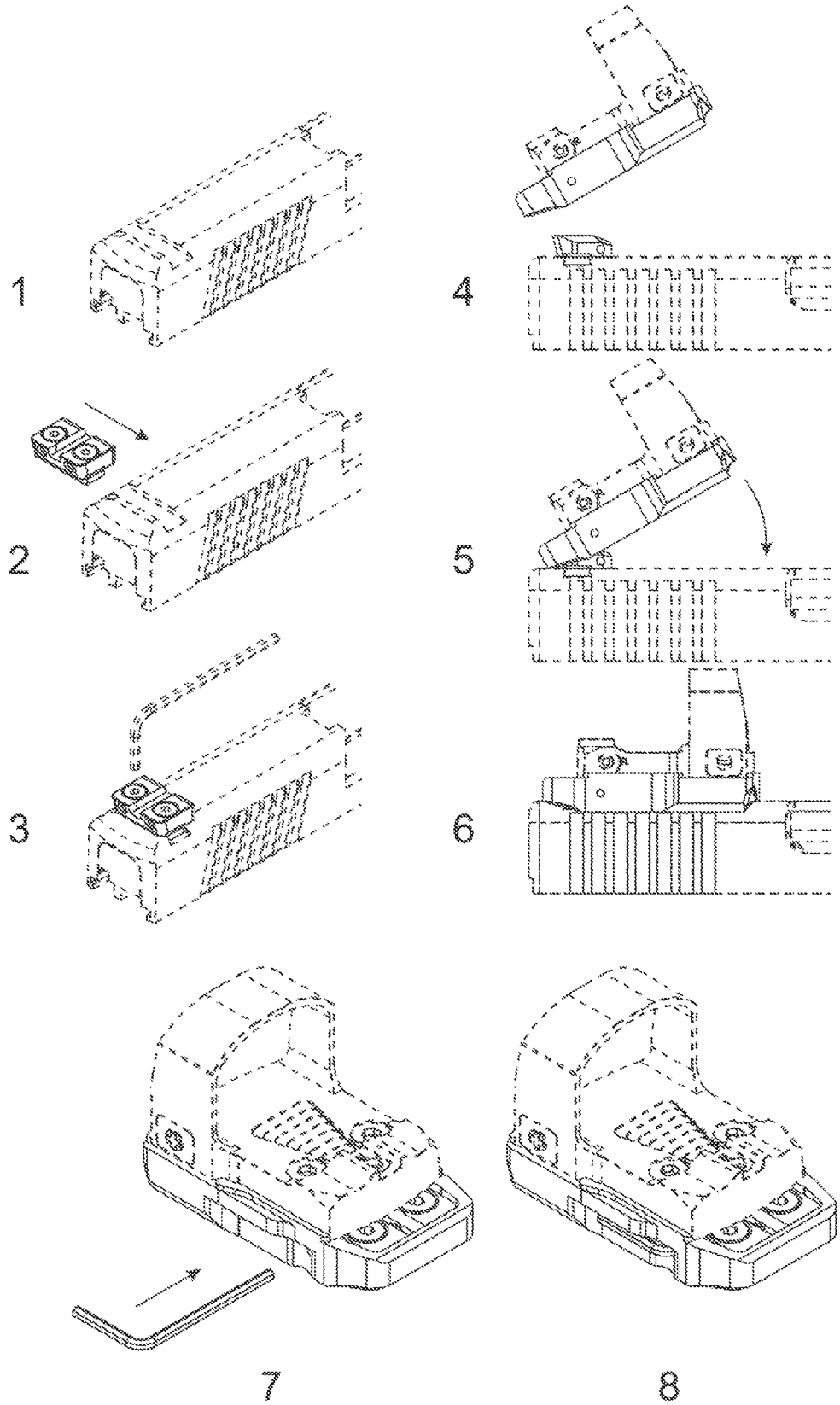
FIG. 50 is a schematic illustrating the steps involved in installing the firearm accessory mount on a firearm.

The firearm accessory mount 10 generally does not require permanent modification of the firearm 70 to be attached to the firearm 70. Instead, the user may only need to remove the original rear sight from the firearm 70. Illustrated in FIG. 50, a method for installing the firearm accessory mount 10 on a firearm 70 may comprise providing a firearm accessory mount 10 that comprises a mechanical anchor 20, a magnet 40, and a mounting plate 13 having at least two passages 14, 15 through the mounting plate 13, providing a firearm 70, attaching the mechanical anchor 20 to the firearm 70, inserting the mechanical anchor 20 into the first passage 14 of the mounting plate 13, placing the mounting plate 13 onto the firearm 70, placing the magnet 40 into the second passage 15, and magnetically coupling the magnet 40 to the firearm 70.

Attaching the mechanical anchor 20 to the firearm 70 may comprise inserting one of a screw, a dowel, a rivet, and a stud through the mechanical anchor 20. The method may further comprising engaging the mechanical anchor 20 with the first passage 14 of the mounting plate 13, mechanically holding the mounting plate 13 to the firearm 70 with the mechanical anchor 20, mounting the mounting plate 13 on the firearm 70 with a lower surface 17 of the mounting plate 13 adjacent to the firearm 70 or in contact with the firearm 70, and/or mounting the mounting plate 13 on the firearm 70 with the longitudinal axis X-X of the mounting plate 13 parallel to a muzzle of the firearm 70. A length of the mounting plate 13 along the longitudinal axis X-X of the mounting plate 13 may be larger than a width or a height of the mounting plate 13. The at least two passages 14, 15, may be aligned along the longitudinal axis X-X. The method may also comprise engaging the protruding lip 24 of the mechanical anchor 20 with a rear wall 11 of the first passage 14 of the mounting plate 13. The protruding lip 24 may be an oblique sloped surface and the first wall 11 may be sloped to form a complementary surface to the protruding lip 24 to facilitate engagement between the mechanical anchor 20 and the mounting plate 13.

The method may also comprise orienting the mounting plate 13 so that the mechanical anchor 20 is closer to a rear end of the firearm 70 than the magnet 40, aligning the slit 23 with the longitudinal axis X-X of the mounting plate 13, and/or mounting an accessory for the firearm 70 on the upper surface 16 of the mounting plate 13. The mechanical anchor 20 may have a slit 23 that is configured to assist the user in aiming the firearm 70. The accessory 50 may be an aiming tool, such as a red dot sight, a laser sight, and a flashlight. The lower surface 17 of the mounting plate 13 may be shaped to conform to the shape of the firearm 70. The method may also comprise positioning an intermediate plate 80 on the firearm 70 and positioning the mounting plate 13 on top of the intermediate plate 80, aligning an aperture extending through the mechanical anchor with corresponding apertures extending through each of two opposing wall of the first passage to form a lock hole, inserting a mount lock into the lock hole to lock the mounting plate to the mechanical anchor, and/or using the mount lock to adjust fasteners used to attach the mechanical anchor to the firearm.

It will be understood that implementations of a firearm accessory mount are not limited to the specific assemblies, devices and components disclosed in this document, as virtually any assemblies, devices and components consistent with the intended operation of a firearm accessory mount may be used. Accordingly, for example, although particular firearm accessory mounts, and other assemblies, devices and components are disclosed, such may include any shape, size, style, type, model, version, class, measurement, concentration, material, weight, quantity, and/or the like consistent with the intended operation of firearm accessory mounts. Implementations are not limited to uses of any specific assemblies, devices and components; provided that the assemblies, devices and components selected are consistent with the intended operation of a firearm accessory mount.

Accordingly, the components defining any firearm accessory mount may be formed of any of many different types of materials or combinations thereof that can readily be formed into shaped objects provided that the materials selected are consistent with the intended operation of a firearm accessory mount. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various firearm accessory mounts may be manufactured using conventional procedures as added to and improved upon through the procedures described here. Some components defining a firearm accessory mount may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling firearm accessory mounts are not limited to the specific order of steps as disclosed in this document. Any steps or sequence of steps of the assembly of a firearm accessory mount indicated herein are given as examples of possible steps or sequence of steps and not as limitations, since various assembly processes and sequences of steps may be used to assemble firearm accessory mounts.

The implementations of a firearm accessory mount described are by way of example or explanation and not by way of limitation. Rather, any description relating to the foregoing is for the exemplary purposes of this disclosure, and implementations may also be used with similar results for a variety of other applications employing a firearm accessory mount.

What is claimed is:

1. A firearm accessory mount, comprising:

a mounting plate having an upper surface, a lower surface opposite the upper surface, and at least two passages through the mounting plate extending from the upper surface to the lower surface, the at least two passages comprising a first passage and a second passage, wherein a length of the mounting plate along a longitudinal axis is larger than a width and a height of the mounting plate, wherein the mounting plate is configured to mount on the firearm with the lower surface adjacent to the firearm and with the longitudinal axis parallel to a muzzle of the firearm, wherein the mounting plate is configured to support an accessory for the firearm on the upper surface, and wherein the at least two passages are aligned along the longitudinal axis;

a mechanical anchor configured to fixedly attach to the firearm and insert into the first passage of the at least two passages, the mechanical anchor having a protruding lip configured to engage with a wall of the first passage distal to the second passage and mechanically hold the mounting plate to the firearm when the mechanical anchor is inserted into the first passage, wherein the protruding lip is an oblique sloped surface and the wall of the first passage distal to the second passage is sloped to form a complementary surface to the protruding lip to facilitate engagement between the mechanical anchor and the mounting plate;

a magnet configured to sit within the second passage of the at least two passages and magnetically couple to the firearm;

wherein the mechanical anchor is configured to be positioned closer to a rear end of the firearm than the magnet; and wherein the mechanical anchor has a top surface with a slit configured to assist the user in aiming the firearm, wherein the slit is configured to align with the longitudinal axis of the mounting plate.

2. The firearm accessory mount of claim 1, the mechanical anchor having at least two holes extending therethrough, each of the at least two holes configured to receive one of a screw, a dowel, a rivet, and a stud to fixedly attach the mechanical anchor to the firearm.

3. The firearm accessory mount of claim 1, wherein the lower surface of the mounting plate is shaped to conform to the firearm and the mounting plate is configured to mount on the firearm with the lower surface in contact with the firearm.

4. The firearm accessory mount of claim 1, further comprising an intermediate plate configured to be positioned between the mounting plate and the firearm and provide a platform for mounting the mounting plate on the firearm.

5. The firearm accessory mount of claim 1, wherein an aperture extends through the mechanical anchor and a corresponding aperture extends through each of two opposing walls of the first passage, the aperture of the mechanical anchor configured to align with the corresponding apertures of the two opposing walls to form a lock hole configured to receive a mount lock when the mechanical anchor is inserted into the first passage, wherein when the mount lock extends through the lock hole, the mounting plate is locked to the mechanical anchor.

6. A firearm accessory mount, comprising:

a mounting plate having an upper surface, a lower surface opposite the upper surface, and at least two passages through the mounting plate extending from the upper surface to the lower surface, the at least two passage comprising a first passage and a second passage, wherein the mounting plate is configured to mount on the firearm with the lower surface adjacent to the firearm and with a longitudinal axis of the mounting plate parallel to a muzzle of the firearm, wherein the mounting plate is configured to support an accessory for the firearm on the upper surface;

a mechanical anchor configured to attach to the firearm and insert into the first passage of the at least two passages, the mechanical anchor having a protruding lip configured to engage with a wall of the first passage distal to the second passage and mechanically hold the mounting plate to the firearm when the mechanical anchor is inserted into the first passage;

a magnet configured to sit within the second passage of the at least two passages and magnetically couple to the firearm; wherein the mechanical anchor is configured to be positioned closer to a rear end of the firearm than the magnet; and the mechanical anchor having at least two holes extending therethrough, each of the at least one hole configured to receive one of a screw, a dowel, a rivet, and a stud to fixedly attach the mechanical anchor to the firearm.

7. The firearm accessory mount of claim 6, wherein a length of the mounting plate along the longitudinal axis is larger than a width and a height of the mounting plate.

8. The firearm accessory mount of claim 6, wherein the at least two passages are aligned along the longitudinal axis.

9. The firearm accessory mount of claim 6, wherein the protruding lip is an oblique sloped surface and the wall of the first passage distal to the second passage is sloped to form a complementary surface to the protruding lip to facilitate engagement between the mechanical anchor and the mounting plate.

10. The firearm accessory mount of claim 6, wherein the mechanical anchor has a top surface with a slit configured to assist the user in aiming the firearm, wherein the slit is configured to align with the longitudinal axis of the mounting plate.

11. The firearm accessory mount of claim 6, wherein an aperture extends through the mechanical anchor and a corresponding aperture extends through each of two opposing walls of the first passage, the aperture of the mechanical anchor configured to align with the corresponding apertures of the two opposing walls to form a lock hole configured to receive a mount lock when the mechanical anchor is inserted into the first passage, wherein when the mount lock extends through the lock hole, the mounting plate is locked to the mechanical anchor.

12. A firearm accessory mount, comprising:

a mounting plate having an upper surface, a lower surface opposite the upper surface, and at least two passages through the mounting plate extending from the upper surface to the lower surface, wherein the mounting plate is configured to support an accessory for the firearm on the upper surface;

a mechanical anchor configured to attach to the firearm and insert into a first passage of the at least two passages, the mechanical anchor configured to engage with the first passage and mechanically hold the mounting plate to the firearm when the mechanical anchor is inserted into the first passage; and a magnet configured to sit within a second passage of the at least two passages and magnetically couple to the firearm;

further comprising an intermediate body positioned between the mechanical anchor and the firearm when the firearm accessory mount is installed on the firearm; and wherein the intermediate body is configured to be inserted into a dovetail slot on the firearm.

13. The firearm accessory mount of claim 12, wherein the mounting plate is configured to mount on the firearm with the lower surface adjacent to the firearm and with a longitudinal axis of the mounting plate parallel to a muzzle of the firearm, wherein a length of the mounting plate along the longitudinal axis is larger than a width and a height of the mounting plate, and wherein the at least two passages are aligned along the longitudinal axis.

14. The firearm accessory mount of claim 12, the mechanical anchor having a protruding lip configured to engage with a wall of the first passage and mechanically hold the mounting plate to the firearm when the mechanical anchor is inserted into the first passage.

15. The firearm accessory mount of claim 14, wherein the protruding lip is an oblique sloped surface and the wall of the first passage is sloped to form a complementary surface to the protruding lip to facilitate engagement between the mechanical anchor and the mounting plate.

16. The firearm accessory mount of claim 12, wherein the mechanical anchor is configured to be positioned closer to a rear end of the firearm than the magnet.

* * * * *